United States Patent [19]

Jumer

[11] 4,001,094

[45] Jan. 4, 1977

[54] METHOD FOR INCREMENTAL ELECTRO-PROCESSING OF LARGE AREAS

[76] Inventor: John F. Jumer, 16 W. 131 Timber Trails Drive, Elmhurst, Ill. 60126

[22] Filed: Sept. 19, 1974

[21] Appl. No.: 507,534

[52] U.S. Cl. ..... 204/129.6; 204/212; 204/224 R

[51] Int. Cl.[2] ..... C25F 3/00; C25F 3/16

[58] Field of Search ..... 204/224 R, 26, 212, 204/129.1, 129.6, 129.5

[56] References Cited

UNITED STATES PATENTS

| | | | |
|---|---|---|---|
| 610,954 | 9/1898 | Thomas | 204/224 R |
| 1,582,407 | 4/1926 | King | 204/224 R |
| 1,771,680 | 7/1930 | Ishisaka | 204/224 R |
| 1,793,069 | 2/1931 | Dunkley | 204/224 R |
| 1,809,826 | 6/1931 | Bohlman | 204/224 R |
| 3,772,163 | 11/1973 | Jumer | 204/26 |

FOREIGN PATENTS OR APPLICATIONS

| | | | |
|---|---|---|---|
| 15,963 | 1/1934 | Australia | 204/26 |

*Primary Examiner*—T. M. Tufariello
*Attorney, Agent, or Firm*—Lockwood, Dewey, Zickert & Alex

[57] ABSTRACT

A dielectric processing chamber unit for use in electroprocessing large surface areas including electropolishing and electroplating. The processing chamber unit has an open face, an open top, a sealing strip, an electrolyte inlet and an electrode. The processing chamber unit is placed with its open face against a surface to be electroprocessed and an electrolyte is introduced into the chamber through the inlet. The inlet is located so that the entering electrolyte dislodges gas bubbles formed during electroprocessing and then both the electrolyte and gas leave the chamber through its open top.

A method of electroprocessing a surface using such a processing chamber unit whereby a relatively small amount of electrolyte is used and recirculated during processing. In this method, the chamber unit is used to electroprocess the inner surface of a vessel concentric about its longitudinal axis whereby the processing chamber unit is temporarily mounted from a shaft maintained on this axis and the chamber unit is rotated around the interior of the vessel during the electroprocessing procedure.

3 Claims, 12 Drawing Figures

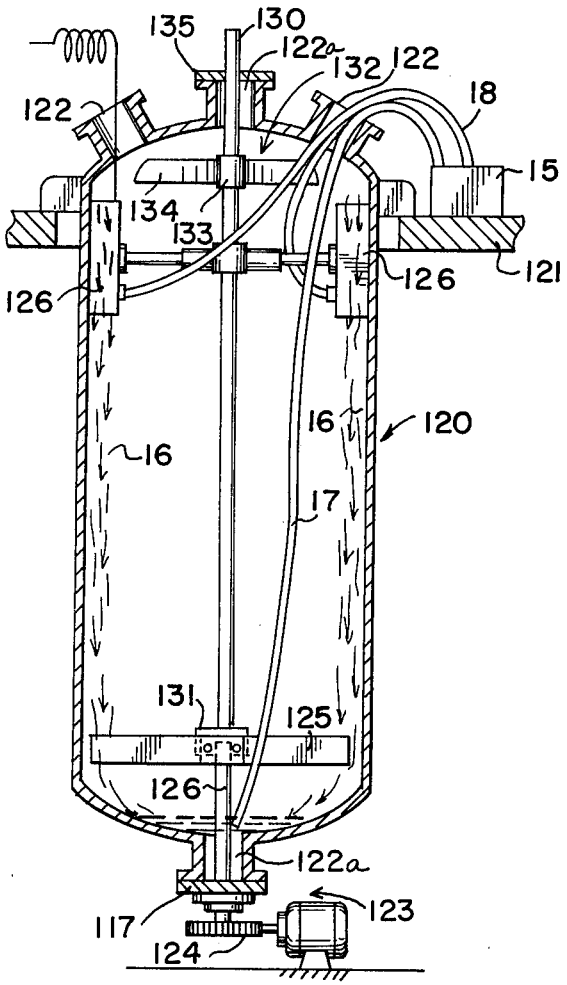
FIG. 11
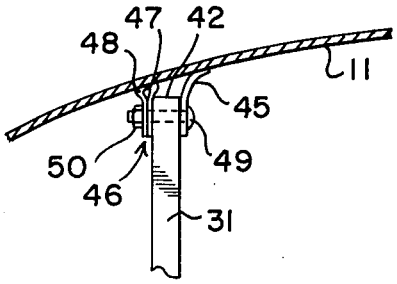
FIG. 12
FIG. 9
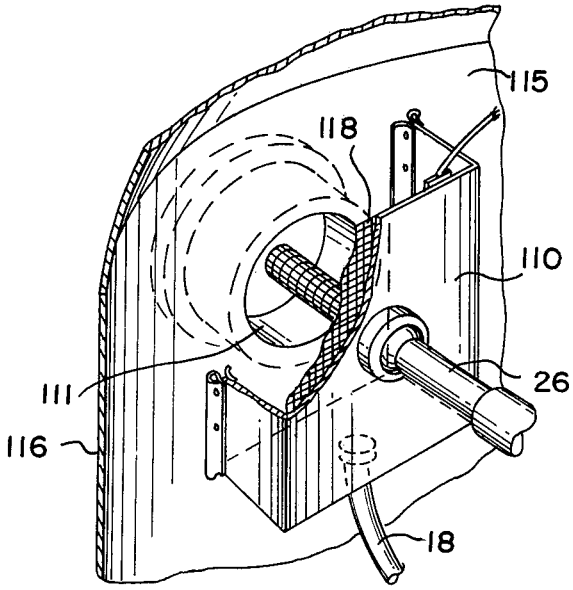
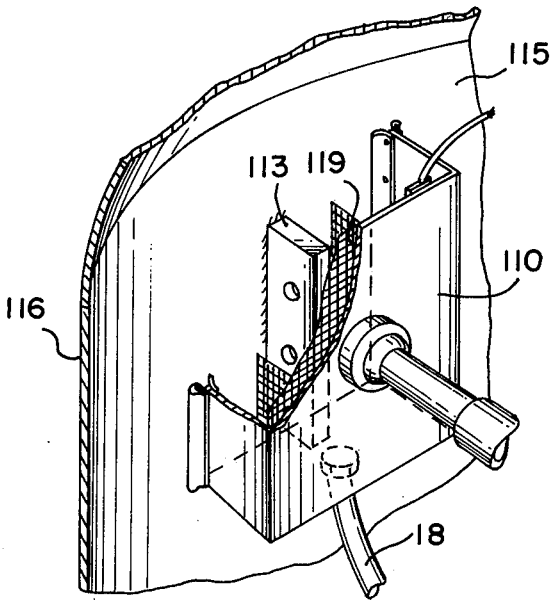
FIG. 10

METHOD FOR INCREMENTAL ELECTRO-PROCESSING OF LARGE AREAS

This invention relates to innovations and improvements in both apparatus and methods for electroprocessing, including both electropolishing and electroplating, wherein an electrolyte is employed. In particular the invention relates to methods and apparatus for electroprocessing large surfaces in increments, especially the interior surfaces of large cylindrical vessels of the type which contain or are capable of containing an axially mounted rotatable shaft.

Cylindrical vessels or reactors which have a capacity of several thousand gallons or more are desirably repaired and maintained while in place. While such work could often be accomplished more efficiently if the vessel could be removed to the workshop, or even changed in position at the site (for example, laid on its side), the size, weight, and generally difficult handling properties of the vessel generally militate against temporary relocation. When work is to be done inside the vessel, the presence of an axially mounted shaft creates an additional condition which may impede the efficient performance of maintenance or repair operations. In a situation frequently encountered, the shaft is installed in a rather permanent fashion, being troublesome or difficult to remove without relocating the vessel, and thus it is necessary to contend with its presence.

Electropolishing or electroplating the interior of large vessels may be conveniently and economically accomplished utilizing the apparartus and method disclosed herein. The differences between electropolishing and electroplating are well known and may necessitate changing the chemical contents of the electrolyte, the direction of electrical current used, and the anode-cathode relation utilized. Briefly, in both electropolishing and electroplating operations metal ions are transferred from an anode through the electrolyte and deposited on the cathode. In electropolishing the surface to be polished is the anode. Conversely, in electroplating the surface to be plated is the cathode and the anode is usually made of the metal to be deposited on the surface. This disclosure will concentrate mainly on one of the processes, i.e., electropolishing, and will discuss electroplating as the process or resultant differs from the electropolishing process.

Often it is desirable that the interior surface of a vessel have a highly polished surface, or a plated surface of a material having special properties. A particularly important example of the former is where the vessel is used for containing a mixture that would stick to the sides of an unpolished vessel. In that situation the high release properties of the polished surface eliminate the sticking problems which would otherwise occur. Because a polished surface is also easier to clean and sanitize, and has high corrosion resistance properties, vessels with such interior surfaces are in use in many industries where these features are desirable, particularly the chemical, food, beverage, drug, and pharmaceutical industries. In many cases the degree of polish or thickness of plating decreases with use and it is necessary to repolish or replate the inner surface of such a vessel on a more or less periodic basis.

Common methods of polishing a surface, at the present time, involve using mechanical means. Although less widely used, a method particularly suited to polishing the interior surface of a vessel is electropolishing by the use of a cathode and an electrolyte or electrolytic bath similar to electroplating methods. However, when the vessel is large it is desirable to take steps to polish its inner surface without either (1) completely filling the vessel with electrolyte, for then problems relating to the large volume of bath arise (for example weight, liquid handling, and expense of the electrolyte); or (2) polishing or plating the entire surface at one time, for then problems relating to electrical requirements arise.

In my prior U.S. Pat. Nos. 2,861,937 and 3,682,799 dated Nov. 25, 1968 and Aug. 8, 1972, respectively, I have disclosed methods for electropolishing the interior surface of large vessels. Using these methods, the inner surface of a vessel may be polished without using a large volume of electrolyte, thus avoiding the problems alluded to above. However, while these inventions represented advances in the polishing art, they are applicable to the situation where the vessel is movable and not where it is fixed in place. Thus, the problems inherent in electroprocessing the inner surface of a vessel which must remain stationary were left unsolved. The present invention provides a simple apparatus and method for electropolishing or plating both flat and curved large stationary surfaces in increments; and in addition it makes advantage, when used in vessels having rotatable shafts, of the presence of the shaft which heretofore had been an impediment.

Accordingly, the primary object of my invention, generally stated, is to provide a method and apparatus whereby the inner surface of a large stationary vessel can be electroprocessed in place, both conveniently and economically.

Another object of my invention is to provide apparatus whereby large metal surfaces can be electroprocessed in discrete increments.

Another object of my invention is to provide a method and apparatus for electroprocessing a large surface whereby a relatively small quantity of electrolyte can be used.

Another object of my invention is to provide a method and apparatus for electroprocessing in sequential circumferential strips or bands the interior surface of a vessel equipped with an agitator or rotor shaft.

Certain other objects of the invention will, in part, be obvious and will appear hereinafter.

For a more complete understanding of the nature and scope of the invention reference may now be had to the following detailed description thereof taken in conjunction with the accompanying drawings wherein:

FIG. 9 is a perspective cut-away view of the inside of a large cylindrical vessel showing the proper processing chamber position for electroprocessing of a recess located therein;

FIG. 10 is a perspective cut-away vie of the inside of a large cylindrical vessel showing the proper processing chamber position for electroprocessing a protuberance located therein;

FIG. 11 is a vertical longitudinal sectional view of a large cylindrical vessel having a bottom entry agitator and a short rotor shaft showing the electroprocessing chambers mounted on an added shaft section attached to the upper end of the rotor shaft and maintained in place at the top of the vessel by a spider support; and FIG. 12 is a detailed sectional view taken on line 12—12 of FIG. 1.

Figure 1:
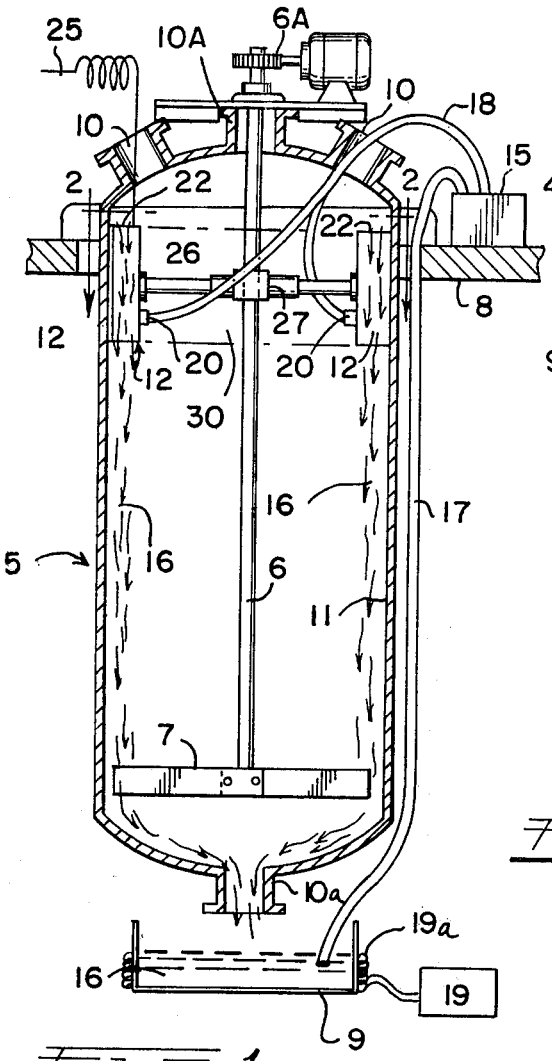
FIG. 1 is a vertical longitudinal sectional view of a large cylindrical vessel with certain parts shown in elevation, having installed therein a rotor shaft which supports an agitator and is also shown supporting a pair of processing chamber units for electroprocessing the vessel interior.
Figure 2:
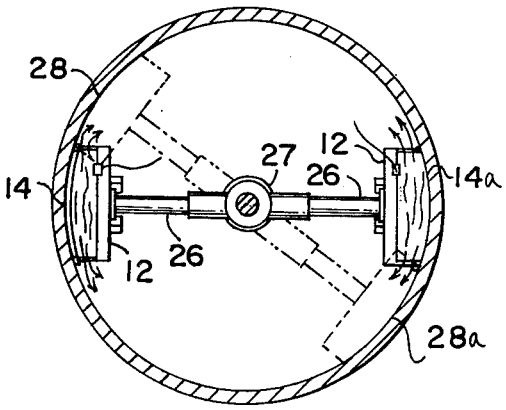
FIG. 2 is a horizontal sectional view taken on line 2—2 of FIG. 1.

Referring to FIGS. 1 and 2, a large cylindrical vessel is indicated generally at 5. For example, the vessel may be 25 feet high with a diameter of 8 feet. The vessel is equipped with a rotatable shaft 6 on which one or more agitators 7 are mounted. The shaft 6 may be driven from the top as shown by any suitable drive means 6*a* of known type. The vessel 5 is supported adjacent the top by floor 8 and is equipped with nozzles or manholes 10 and similar necked openings 10*a* located at one or both ends of the vessel. Opposed box-like processing chamber units or electrolyte containers indicated generally at 12—12, are used for retaining relatively small quantities of electrolyte 16 which make contact with discrete increments 14–14*a*, respectively, of the surface 11 to be electroprocessed. A pump 15 draws the electrolyte 16 from a portable reservoir 9 located beneath the bottom of vessel 5 through return hose 17 and supplies processing chambers 12—12 with electrolyte 16 through inlet hoses 18—18. In this embodiment, bottom necked opening 10*a* is uncovered to allow the electrolyte 16 to drain from vessel 5 into reservoir 9 for recirculation. Electrolytic liquids may have optimum operating temperatures. If heating or cooling means (not shown) are located in the wall of the vessel 5, those means may be employed to maintain the electrolyte at a desired temperature. Otherwise, any suitable external heating and cooling means such as at 19 may be attached to coils 19*a* or like transfer means in or on the reservoir 9 to condition the electrolyte temperature. The rate of delivery of pump 15 is adjusted to deliver enough electrolyte 16 to each processing chamber so (1) gas bubbles 21 formed during electroprocessing are dislodged as required, and (2) each processing chamber unit 12 is kept substantially full. Gas bubbles are formed during both electropolishing and electroplating. The gas bubbles 21 (FIG. 4) and any excess electrolyte delivered to each unit may overflow processing chambers 12—12 and drain down to the reservoir 9 and thereby be available for reuse. The suction end of return hole 17 may also be in each chamber unit 12 thereby providing recirculation of electrolyte 16 without overflowing the chamber. Each chamber or container 12 is temporarily supported from shaft 6 by an extensible arm 26 which maintains the chamber against the vessle wall. Each arm 26 is carried by a collar-like clamp 27 removably affixed to shat 6. Arm 26 is made extensible from collar 27 to maintain a pressure contact between the chamber 12 and the vessel inside surface wall 11. Arm 26 may be suitably spring loaded, threaded, or otherwise mounted in clamp 27 so as to exert an outward pressure to the chamber. When the appropriate amounts of current and electrolyte are supplied to the chamber units 12—12, each of the discrete increments 14–14*a* of surface 11 is electropolished. If the current is reversed and the proper electrolyte used, it will be understood that surface 11 will be electroplated with metal fromm each chamber unit 12.

In the preferred embodiment of the invention, shaft 6 is slowly rotated 180° or more while electropolishing or plating takes place whereby a circumferential band 30 is electroprocessed on surface 11. Alternatively, the circumferential band 30 on surface 11 may be stepwise processed, as shown in FIG. 2, by first electropolishing the discrete increments 14–14*a* and then rotating shaft 6 so that new discrete increments 28–28*a* of surface 11, which are upolished areas, are contacted by electrolyte 16 in chamber units 12—12 and then polished. This alternative procedure may be repeated until a band 30 on surface 11 is electropolished. When band 30 is electropolished, by either method above, the apparatus is relocated by loosening clamp 27 and repositioning chamber units 12—12 vertically so they are in contact with an unpolished surface area and the previous procedure is repeated. Slight overlapping at the top and bottom of the bands may be desirable. Electroplating may likewise be accomplished in the same manner. It will be understood that electroprocessing bands around the inside of a vessel according to the invention may be accomplished by utilizing one, two, or more processing chambers, In the preferred embodiment illustrated two processing chambers 12—12 are employed because they (a) balance the load sustained by the shaft 6, and (b) process a band twice as quickly as when utilizing one chamber. The two chamber units 12— may be staggered vertically to process two bands at one time. Also, if only one chamber unit is to be utilized, a counter weight preferably replaces the second chamber unit.

Figure 3:
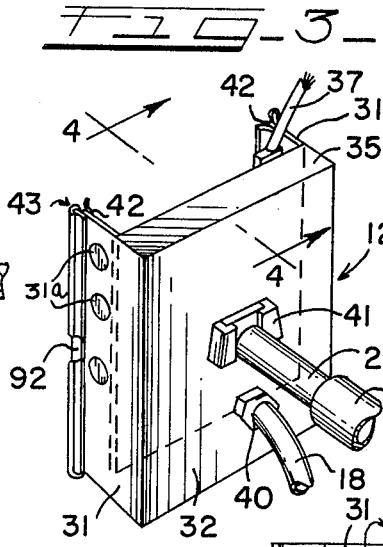
FIG. 3 is a perspective view, taken from the back and top of one of the box-like processing chambers shown in FIG. 1 for electroprocessing a large vertical surface in increments.
Figure 4:
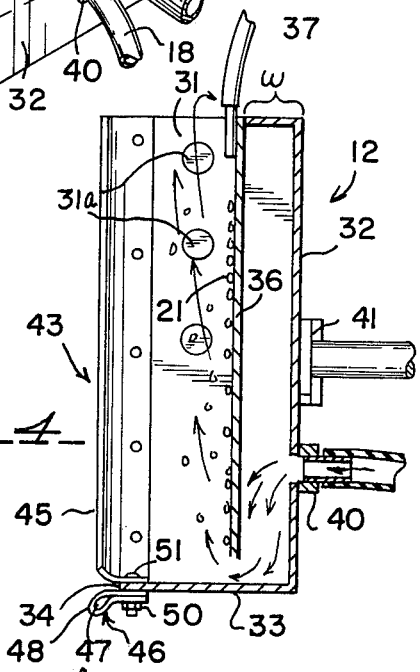
FIG. 4 is a vertical sectional view taken on line 4—4 of FIG. 3.

For detailed understanding of the processing chamber construction, reference may now be had to FIGS. 3 and 4. The processing chamber unit, generally shown at 12, is preferably made of dielectric sheet material such as rubber, plastic, wood, or the like although electrically conductive materials may be utilized if they have a non-conductive interior surface. Such dielectric sheets are easy to cut to size and may be joined securely together speedily on the job site if a unique shape chamber is desired. The embodiment of processing chamber unit 12 is utilized for processing vertical or neaer vertical surfaces, forms a box-like structure, and includes substantially rectangular side walls 31—31 and back wall 32 connected therebetween. A bottom wall 33 is connected at its sides to the back wall and side walls and may have a rectilinear or curvalinear leading edge at 34 which preferably approximates the cross-section of the surface to be processed. A top wall 35 connected to the sides ad back wall may be abbreviated in width W or eliminated so to to leave an open space for allowing bubbles 21 or excess electrolyte 16 to exit by overflowing the chamber unit. Plugged outlet holes 31*a* may be selectively open, closed, or connected to return hose 17 thereby determining th height of electrolyte in the chamber and the width or electroprocessed band 30. An electrode 36 is mounted in processing chamber unit 12 and aligned approximately parallel to the surface to be processed and is connected by conductor 37 to the appropriate pole or terminal of a source of direct current. In electropolishing the electrode 36 is a cathode and in electroplating it is an anode.

Electrode 36 may be a solid sheet of metal, perforate, or screen-like in structure. In FIGS. 3 and 4, the electrode 36 is solid and is mounted in the chamber mediately between the back wall 32 and the surface to be processed thereby forming a baffle for electrolyte 16 flowing through the inlet fitting 40. Baffle electrode 36 causes the electrolyte 16 to have a rapid upward flow between the electrode and the surface to be processed, thereby dislodging bubbles 44 which form on the vessel wall 11 and electrode during electroprocessing. It can be appreciated that electrode 36 may be placed adjacent the back wall 32 of chamber unit 12 or at any other suitable position in the chamber unit. The location of the electrode 36 may also eliminate the necessity of a top wall 35. In this embodiment, chamber unit 12 is connected to arm 26 at mounting 41 located on backside 32.

The leading edges 42—42 and 34 of side walls 31—31 and botom wall 33, respectively, define the border of an open face in chamber unit 12. These leading edges isolate the segment 14 of the vessel surfce 11 to be electroprocessed when the chamber unit 12 is placed on the vessel wall 11. A sealing means generally shown at 43, also shown in FIG. 12 in more detail, is attached to the chamer unit 12 in a substantially continuous manner around the sides defining the open face and provides a flexible sliding seal contact between the leading edges 42—42 and 34 and the surface 11 to be electroprocessed in order to retain th electrolyte 16 within the chamber. The surface increment 11 temporarily becomes a wall of the chamber 12, thereby containing the electrolyte therein. While any suitable seal may be utilized, one effective sealing means includes a thin rubber wiper strip 45 affixed to the inside of each leading edge which deforms inwardly to maintain a pressure contact with vessel surface 11. The sealing means 43 also includes a sturdy, strong, and yet pliable secondary seal, generally at 46, affixed to the outside of each leading edge having a soft sponge rubber interior portion 47 and a more durable rubber outer layer 48 which contacts the vessel surface 11 during electroprocessing. Bolts 49 and nuts 50 or other fastening means may secure the sealing means 43 to the chamber unit 12.

Figure 5:
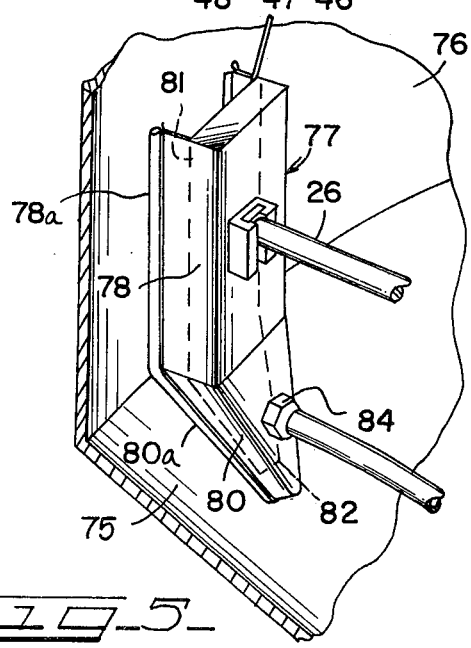
FIG. 5 is a fragmentary perspective view, taken from the side and top of the inner surface of a large vessel with an angular bottom, showing a variation of a processing chamber unit for electroprocessing a large surface of such a vessel in increments.

FIG. 5 shows an embodiment wherein the invention is employed for processing the inner surface of a vessel concentric about an axis where the configuration is not completely cylindrical. Here the lower or bottom portion 75 of the vessel surface is frusto-conical while the upper side wall portion 76 is cylindrical. The chamber, generally at 77, is constructed so that the sides 78 and 80 have leading edges and seals 78*a* and 80*a* which are shaped to generally conform to the shape of surfaces 75 and 76, respectively. The electrode 81 is similarly shaped with its bottom edge 82 located a sufficient distance from the chamber bottom to permit the electrode 81 to serve as a baffle for the liquid entering through the liquid inlet 84. The chamber 77 is mounted from the rotatable shaft (not shown) by extensible arm 26 and electroprocessing is accomplished as previously described.

Figure 6:
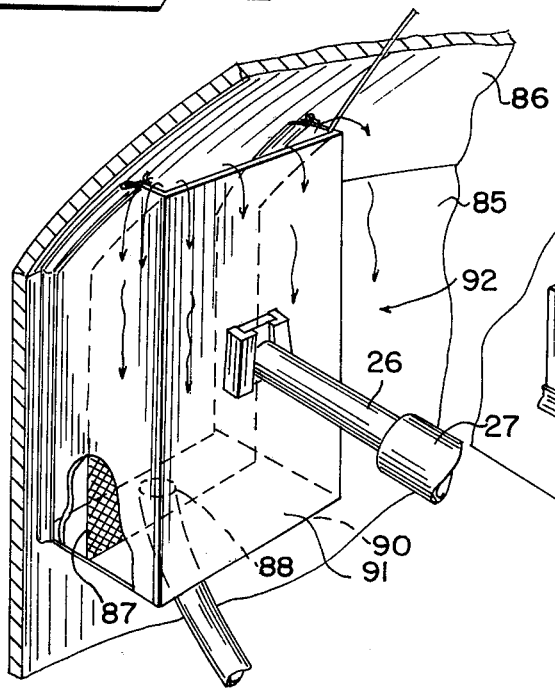
FIG. 6 is a fragmentary perspective view, taken from the back and top, of a processing chamber for electroprocessing the top of the sidewall and a portion of the dome top of a large cylindrical vessel.

FIG. 6 shows an embodiment wherein the invention will simultaneously electroprocess discrete portions of the cylindrical side wall 85 and a portion of the domed top 86 of a vessel. In this embodiment the electrode 87 is screen or perforate metal and the electrolyte inlet 88 is located in the bottom 90 rather than the back 91 of the chamber generally shown at 92. It will be understod that most of the interior surface of a closed top vessel can be electroprocessed as long as (1) the surface is not completely horizontal and (2) enough space is maintained between the top of the chamber and the highest point on the surface to be processed so that gas bubbles may escape the chamber. It should be noted that the top portion of a vessel may not have to be polished or plated. In many instances vessels, especially those equipped with agitators therein, are for practical purposes, considered filled before the contents reach the top of the vessel.

Figure 7:
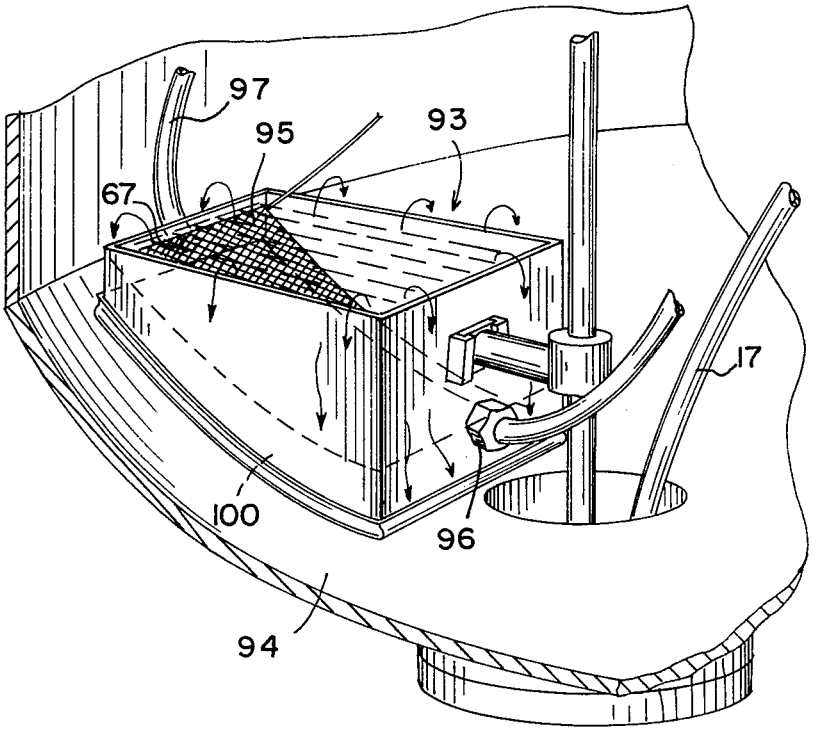
FIG. 7 is a fragmentary perspective view, taken from the side and top of a processing chamber for electroprocessing a portion of the curved bottom of a large cylindrical vessel.

The embodiment in FIG. 7 shows a chamber, generally at 93, used to electroprocess a porton of the bottom surface 94 of a vessel. In this embodiment a wire mesh electrode 95 is shown and the electrolyte 16 is introduced into chamber 93 by two inlets 96 and 97. This embodiment has a completely open top as compared to the embodiments shown in FIGS. 3 and 5 where the top was only partially open. Here the face opening 100 is at the bottom of the chamber 93 rather than at the side as previously shown. The bottom of a fixed vessel such as shown in FIG. 7 may also be electroprocessed by utilizing a curved electrode (not shown) which approximates the vessel bottom curvature and is attached to the shaft 6 as disclosed in my prior U.S. Pat. No. 3,682,799.

Figure 8:
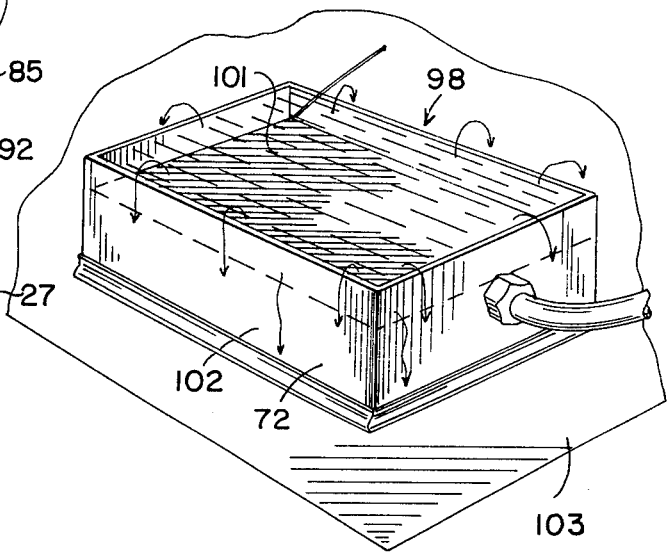
FIG. 8 is a fragmentary perspective view, taken from the sides and top, of a processing chamber for electroprocessing a portion of a large flat horizontal surface.

FIG. 8 also shows a chamber, generally at 98 with a completely open top, a wire mesh electrode 101, and a face opening 102 on the bottom. This embodiment is used to electroprocess a flat horizontal surface 103, which may or may not be a part of the vessel. It will be understood that this embodiment can also be used to electroprocess sheets or plates indiscrete increments.

No unique problems are encountered when electroprocessing uniform increments 14 of a cylindrical surface 11, as shown in FIG. 2. However, FIGS. 9 and 10 illustrate a method for electroprocessing structural deviations from uniformity on a vessel wall 116. The chamber 110 utilized should cover the entire deformation during electroprocessing so that no electrolyte leakage occurs through any gap in the deformation-chamber wall interface. The use of easily formable plastic sheeting allows the construction of a uniquely shaped processing chamber unit at the job site. In FIG. 9, the chamber unit 110 is placed squarely over a nozzle or manhole 111 located in the side wall 115 of vessel 116 before the electrolyte is added through tube 18. An electrode 118 made of wire mesh may be easily custom formed in a tubular shaped to provide an electrode surface which is parallel to the manhole surface 111. Also, the outer portion of manhole 111 is capped or plugged to prevent leakage. The manhole 111 is then electroprocessed as previously described without having to move the chamber 110.

In FIG. 10 a flange 113 protruding into the interior of the vessel from surface 115 is electroprocessed in the same manner as the manhole. The chamber 110 is placed around the entire protruding flange 113 so that an adequate seal exists between the chamber and surface of the vessel 115. The electrolyte is added to the chamber through tube 18. Cathode 119, also custom formed to have portions parallel to the flange sides, is electrically charged to electroprocess the flange surfaces. After the flange 113 or manhole 111 is processed, the electrolyte 16 is drained, the chamber 110 is moved clear of the surface deformation, and the electroprocessing is continued on the remaining uniform portions of the vessel wall.

Referring to FIG. 11, another large cylindrical vessel is indicated generally at 120. The vessel is similar to that previously described in FIG. 1 in that it is generally cylindrical in shape, supported by floor 121, and is equipped with manholes 122, and top and bottom necked openings 122*a*. However, vessel 120 is equipped with a bottom entry agitator system generally at 123. The agitator drive mechanism 124 may be similar to drive mechanism 6*a* shown in FIG. 1. In order to plce agitator 125 in a position corresponding to agitator 7 in vessel 5, a much shorter rotatable shaft 126 is connected to the drive mechanism through a mounting 117 attached to the bottom necked opening 122*a*. In order to mount the chamers 126—126 in the vessel 120 in the manner shown in FIG. 1, a shaft extension 130 is added to the upper end of shaft 126 by means of a suitable collar 131 connecting the shafts. Shaft extension 131 is maintained in fixed rotatable position at the top of vessel 120 by a spider support, generally at 132, having a hub 133 through which the shaft is received and a plurality of arms 134 which bear against the walls of the vessel maintaining the support in position. Alternatively, an apertured bearing plate 135 may be attached to the top of top mecked opening 122*a* for supporting the shaft 130 passing therethrough. Electrolyte return tube 17 in this embodiment collects liquid at the bottom of vessel 120 since plate 117 closes bottom necked opening 122*a* and does not permit the use of a reservoir therebeneath. Chambers 126 may now be mounted on shaft extension 130 allowing the vessel to be electroprocessed in the manner previously described in connection with FIG. 1.

It will be understood that if no shaft is permanently mounted in vessel 120, shaft extension 130 may extend all the way through the vessel and be maintained in position therein by spider or other supports at opposite ends of the vessel.

While the embodiments shown have had one or two inlets, it will be understood that more liquid inlets may be used, it will also be understood that the choice of electrodes is not limited to either a plate or a mesh but that a perforate electrode, a combination of these types, or others may be also be used.

It will be understood that certain modifications and variations may be effected without departing from the scope of the novel concepts of the present invention and that this application is limited only by the scope of the appended claims.

I claim:

1. A method for incrementally electro-polishing the interior metal surface of a stationary vertically oriented vessel having closed ends and a side wall generally concentric about its vertical axis with at least one of said closed ends having an access port, said vessel including an agitator therein positioned on a shaft which is adapted for rotation, and said shaft being mounted along at least a portion of the vertical axis of said vessel, said method comprising the steps of:

removably affixing an extensible arm and processing chamber means on said agitator shaft, said extensible arm being mounted on said shaft, and said processing chamber means being mounted on the distal end of said shaft, and having a first face opening for sequentially masking increments of said metal surface to be electro-polished;

extending said extensible arm until a sealing means at the edges of said first face opening substantially sealingly engage an increment of said metal surface;

introducing and maintaining an electrolyte in said processing chamber means;

supplying current to an ungrounded electrode forming a cathode positioned in said processing chamber means which is in communication with said electrolyte positioned therein to electro-polish said metal surface increment;

rotating said processing chamber unit laterally around the interior of said vessel to a position on said metal surface where at least a portion of a surface increment forming a wall of said chamber unit is unpolished; and moving said extensible arm and chamber unit connected thereto vertically along said shaft and removably affixing same when said chamber unit open face is contacting at least a portion of said vessel interior surface which is unpolished.

2. The method as called for in claim 1 wherein the step of removably affixing said extensible arm and processing chamber means on said agitator shaft further includes the steps of:

forming said electrode means to the shape of the contours of said metal surface increment to be electro-polished to provide approximate equidistant spacing between said electrode and said metal surface increment during electro-ppolishing; and mounting said electrode in said processing chamber means.

3. The method as called for in claim 1 wherein the step of vertically moving said extensible arm and said processing chamber means along said agitator shaft further includes the step of:

removably affixing a portable shaft to the distal end of said rotatable agitator shaft for extending same along the length of said vessel providing for extended vertical movement of said extensible arm and said processing chamber means.

* * * * *

UNITED STATES PATENT AND TRADEMARK OFFICE

CERTIFICATE OF CORRECTION

PATENT NO. : 4,001,094

DATED : January 4, 1977

INVENTOR(S) : John F. Jumer

It is certified that error appears in the above-identified patent and that said Letters Patent are hereby corrected as shown below:

Column 2, Line 24, "makes" should be --takes--;

Column 3, Line 16, "vie" should be --view--;

Column 4, Line 16, "fromm" should be --from--;
Line 45, "12-" should be --12-12--;
Line 60, "neaer" should be --near--;
Line 67, "ad" should be --and--;

Column 5, Line 4, "th" should be --the--;
Line 41, "th" should be --the--;

Column 7, Line 23, "plce" should be --place--;
Line 26, "chamers" should be --chambers--;
Line 36, "mecked" should be --necked--;

Column 8, Line 49, "ppolishing" should be --polishing--.

Signed and Sealed this

Fifth Day of April 1977

[SEAL]

*Attest:*

RUTH C. MASON
*Attesting Officer*

C. MARSHALL DANN
*Commissioner of Patents and Trademarks*